United States Patent [19]

Morelli

[11] Patent Number: 5,046,606

[45] Date of Patent: Sep. 10, 1991

[54] CONTAINER FOR NAIL CLIPPINGS

[76] Inventor: Louis A. Morelli, 118 Saddle Brook Dr., Oak Brook, Ill. 60521

[21] Appl. No.: 549,483

[22] Filed: Jul. 6, 1990

[51] Int. Cl.[5] ..... B65D 85/00; A45D 29/00

[52] U.S. Cl. ..... 206/37; 30/28; 132/73.5

[58] Field of Search ..... 30/26-29; 132/73, 73.5, 73.6, 74.5, 75, 285; 206/37, 581, 823; 220/4.21, 4.24, 229; 232/43.4

[56] References Cited

U.S. PATENT DOCUMENTS

| | | | |
|---|---|---|---|
| 2,364,007 | 11/1944 | Stanton | 220/4.21 |
| 3,903,596 | 9/1975 | Crosby | 30/29 |
| 3,943,948 | 3/1976 | Sartore | 30/28 |
| 4,289,152 | 9/1981 | Fuhre | 132/75 |
| 4,341,015 | 7/1982 | Young | 30/28 |
| 4,359,060 | 11/1982 | Walker | 132/75 |
| 4,577,754 | 3/1986 | Jones | 30/28 |
| 4,602,721 | 7/1986 | Hicks | 232/43.4 |
| 4,697,854 | 10/1987 | Lunsford | 220/4.21 |
| 4,956,915 | 9/1990 | Anderson | 132/73.5 |

FOREIGN PATENT DOCUMENTS

| | | | |
|---|---|---|---|
| 0534230 | 1/1955 | Belgium | 132/73.5 |
| 0428118 | 3/1946 | Italy | 132/73 |

*Primary Examiner*—Jimmy G. Foster

*Attorney, Agent, or Firm*—Laff, Whitesel, Conte & Saret

[57] ABSTRACT

A container for retaining clipped nails comprising a hollow shell having a first opening and a second opening, the first opening being adapted to receive a digit and the second opening being adapted to receive a cutting tool, wherein the digit extends through the first opening into the interior of the container and contacts the cutting tool which extends through the second opening into the interior of the container. During the application of the cutting tool to the nail of the digit, the trimmed nails are retained by the shell.

7 Claims, 3 Drawing Sheets

CONTAINER FOR NAIL CLIPPINGS

FIELD OF THE INVENTION

This invention relates to a container for nail clippings. More particularly, this invention relates to a container for holding fingernail and toenail clippings which prevents the scattering of nail clippings during the nail cutting process.

BACKGROUND OF THE INVENTION

It is well known that fingernails and toenails require periodic maintenance including cleaning, cutting and shaping. Nails are cleaned and shaped with instruments such as nail files and orange sticks, whereas nails are cut by a variety of tools including nail clippers or scissors.

While nails may be cleaned and shaped with relatively little mess, it is extremely difficult to cut nails without creating nail litter in the surrounding cutting area. Nail litter is an unavoidable by-product of the cutting process as nails have the propensity to fly away in numerous directions from the toe or finger undergoing the cutting because of the rigid texture and horny plate composition of the nail.

Nail litter is further problematic in that it is often difficult to detect because of the small size of the nails. Moreover, in certain circumstances, visibility of the nails is not the problem but instead the task of collecting the cut nails is difficult, especially if the nails have fallen into a deep rug.

Nail litter is therefore not only often difficult to detect, collect and discard, but may also be an excellent source of germs and dirt which collect beneath the nails Accordingly, much of the nail litter may include nails with germs and dirt.

Aside from the aforementioned problems associated with the cutting process of nails, there are additional maintenance problems that involve the toenails. Specifically, it is difficult to cut toenails because of their location on the foot which is not as readily accessible as, for example, fingernails on a hand. Moreover, the inaccessibility of toenails is further complicated by the fact that the toes are angled away from the foot and body. The inaccessibility of the foot and toenails is again exaggerated in the case of an elderly or overweight person, both of which may discover hardship in bending over to accomplish the cutting process.

Accordingly, an object of the present invention is to provide a container for holding fingernail and toenail clippings.

Another object of the invention is to provide a container for holding fingernail and toenail clippings which prevents the scattering of nail clippings during the nail cutting process.

Another object of the invention is to provide a container for holding fingernail and toenail clippings that is compatible with all finger and toe sizes.

Another object of the invention is to provide a container for holding fingernail and toenail clippings that is compatible with all conventional nail clippers.

A further object of the invention is to provide a container for holding fingernail and toenail clippings which may be easily opened and emptied of any contents therein.

A further object of the invention is to provide a container for holding fingernail and toenail clippings that provides a mechanism to elevate an individual digit and thereby create a more optimal angle in the digit for the cutting process.

A further object of the invention is to provide a container for holding fingernail and toenail clippings which is inexpensive to manufacture.

Additional objects and advantages will become apparent from the following description and the drawings.

SUMMARY OF THE INVENTION

The present invention, in a first, second and third embodiment, comprises a structure that accomplishes the foregoing objects by providing a container for holding nail clippings having a hollow, generally cylindrical body with a detachably removable top portion and a first and second diametrically opposed opening that is adapted to receive a cutting or clipping instrument and a digit or other appendage, respectively. The openings each include a first and second grommet, respectively. The digit or other appendage is inserted through the first grommet and into the first opening of the container. The cutting or clipping instrument is inserted through the second grommet and into the second opening of the container. After insertion, the nail on the digit or other appendage is cut inside the container by the clipping instrument. The cut nails are collected inside of the container.

In a fourth embodiment of this invention, the container further includes a mechanism that is adapted to elevate an individual digit and create an optimal angle in the digit for the cutting process. The mechanism comprises at least one slideably movable actuator having locking means thereon which is adapted to move the digit from a first position into a locked second or third position. The locked second or third position creates a more favorable incline in the digit for the cutting process.

All of the aforementioned embodiments may comprise containers having numerous shapes including, but not limited to, spheres, rectangles, square and cones. Thus, while this invention may encompass many shapes, reference is made herein to only a few of these structures.

The above, as well as other objects and advantages of the invention, will become apparent from the following detailed description of the preferred embodiments, reference being made to the accompanying drawings.

DETAILED DESCRIPTION OF THE INVENTION

Figure 3:
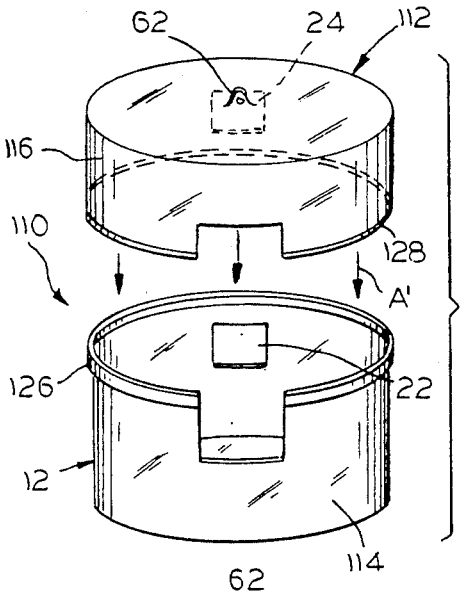
FIG. 3 is a perspective view of a second embodiment of the inventive container for nail clippings, illustrating its detachable top.
Figure 2A:
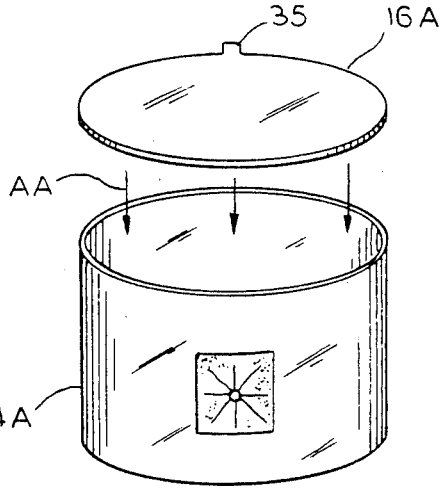
FIG. 2A is a perspective view of the inventive container of FIG. 1, illustrating an alternate detachable top.
Figure 4:
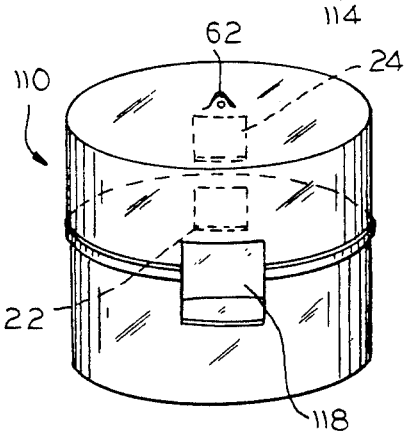
FIG. 4 is a perspective view of the inventive container of FIG. 3, shown in its closed position.

The invention provides a container 10 in a first embodiment (FIGS. 1-2, 2A, 5-6, 8-9 and a second embodiment 110 (FIG. 3-4) having, in part, a hollow, generally cylindrical or oblong shell 12, 112 which includes a lower portion 14, 114 which is larger than the diameter of the top portion 16, 116. Alternatively, shells 12, 112 may include a detachably removable lid 16A, 116A. In the first embodiment, container 10 includes a first opening 18 and a second opening 20 which are diametrically opposed to one another. In the second embodiment (FIGS. 3-4), shell 112 includes a first opening 118 and second and third openings 22, 24, respectively. A digit fits into first opening 18 and 118 of the first and second embodiments, respectively. A nail clipper 26 is inserted into second opening 20 of the first embodiment and second and third openings 22, 24, respectively, of the second embodiment.

Referring to the first and second embodiments, as shown in FIGS. 1-6, 8-9, shell 12, 112 includes a removably detachable lower portion 14 having a first circumferentially extending lip 26, 126 that is slightly larger than the diameter of a second circumferentially extending lip 28, 128 on top portion 16, 116. Top portion 16, 116 of the first and second embodiments is attached to bottom portion 14, 114 by inserting the smaller second lip 28, 128 of top portion 16, 116 into the larger first lip 26, 126 of bottom portion 14, 114 as indicated by the arrows A and A' in FIGS. 2 and 3, respectively. Alternatively, shell 12, 112 may include a removably detachable top portion or lid 16A which snaps into and is frictionally engaged by lower portion 14A, as indicated by arrows AA in FIG. 2A. Lid 16A further includes a lifting means or tab 35 which is positioned along the perimeter of lid 16A and which provides a mechanism for removing lid 16A from bottom portion 14A.

Figure 1:
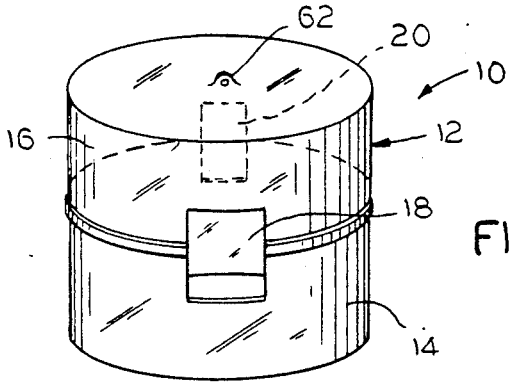
FIG. 1 is a perspective view of a first embodiment of the inventive container for nail clippings shown in its closed position.
Figure 2:
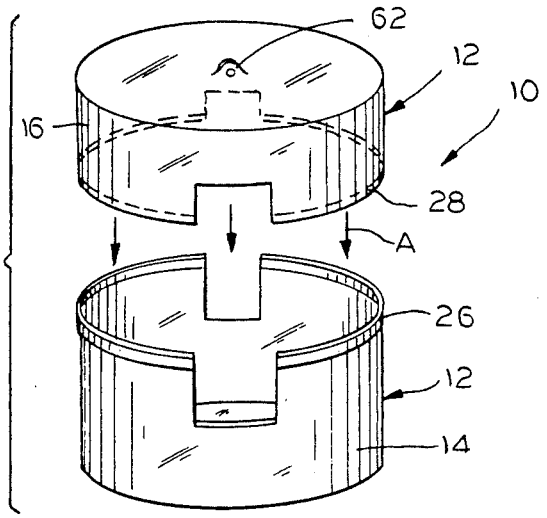
FIG. 2 is a perspective view of the inventive container of FIG. 1, illustrating its detachable top.

Both the first and second embodiments include diametrically opposed openings. As shown in FIG. 1, the first embodiment has a first opening 18 which is slightly larger than a second diametrically opposed opening 20, both of which are formed when lower portion 14 and top portion 16 are attached, as illustrated in FIG. 2. Likewise, the second embodiment has a first opening 118 that is formed when lower portion 14 and top portion 116 are attached. The second embodiment further includes second and third openings 22, 24, which are located on lower portion 114 and upper portion 116, respectively.

Figure 5:
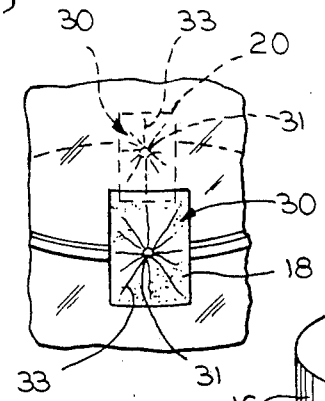
FIG. 5 is a fragmented perspective view of the openings of the inventive container of FIG. 1.

FIG. 5 illustrates first and second opening 18, 20 of the first embodiment as they appear with a flexible grommet 30 which includes a center opening 31 having slits 33 which extend radially outward from opening 31. Similarly, openings 118, and 22, 24 of the second embodiment each include a flexible grommet (not shown). Grommet 30 of both embodiments is attached to that portion of each opening that is located on the lower portion 14 and 114 of the first and second embodiments, respectively, by an adhesive or the like and is not actually attached to that portion of the openings located on the upper portions 16, 116 of the first and second embodiments, respectively. This structure allows for the lower portion 14, 114 to be detached from the upper portion 16, 116 of the first and second embodiments, respectively, without completely removing grommet 30 from the openings.

Grommet 30 enables objects, including nail clippers and digits, to move into and out of shell 12 and 112 while prohibiting the contents therein from falling out. Grommet 30 is flexible enough so that both the nail clipper and digit have substantial lateral movement. The grommet is large enough to accommodate clippers and digits of various sizes and shapes.

Figure 6:
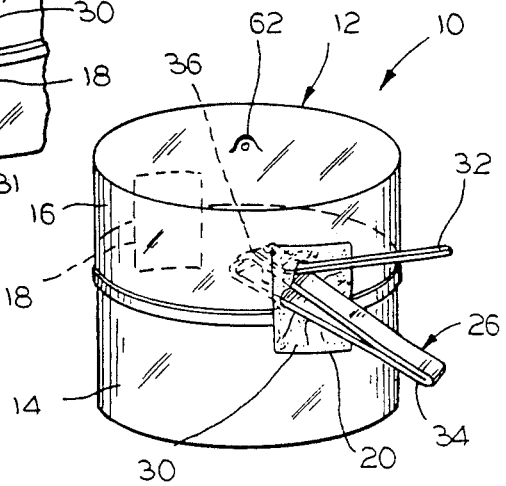
FIG. 6 is a perspective view of a conventional nail clipper being inserted into one of the openings of the container of FIG. 5.
Figure 7:
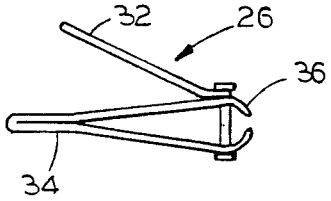
FIG. 7 is a side view of a conventional nail clipper.

FIG. 6 illustrates a nail clipper 26 moving through grommet 30 and into second opening 20 of shell 12 of the first embodiment. Nail clipper 26, as shown in FIG. 7, includes a handle 32 and cutting portion 34. Clipper 26 is inserted into opening 20 such that front end 36 projects into the interior of shell 12 and handle 32 protrudes outwardly from shell 12. Clipper 26 is securely held within shell 12 due to the resiliency of grommet 30.

Figure 8:
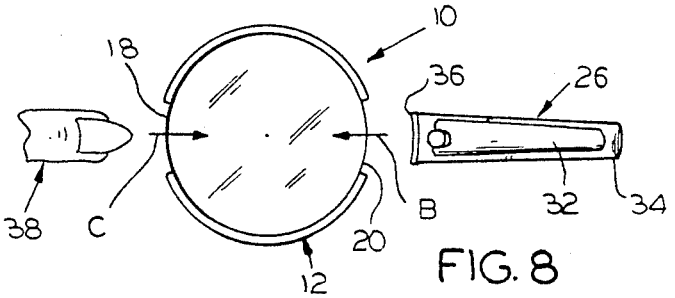
FIG. 8 is a plan view of the inventive container of FIG. 1, illustrating the insertion of a digit and the nail clipper of FIG. 7 into the container.
Figure 10:
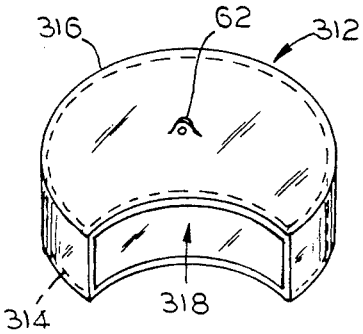
FIG. 10 is a perspective view of a third embodiment of the inventive container, shown in its closed position.

FIG. 8 shows clipper 26 being inserted through opening 20 into shell 12, as indicated by arrows B. FIG. 8 further shows a digit 38 being inserted into shell 12 through opening 18, as indicated by arrows C.

Figure 9:
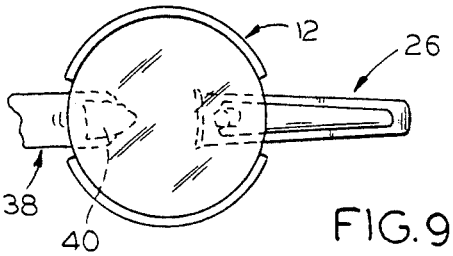
FIG. 9 is a plan view of the inventive container of FIG. 1, showing a digit and the nail clipper of FIG. 7 subsequent to their insertion into the container.

FIG. 9 illustrates clipper 26 and digit 38 subsequent to their insertion, as shown in FIG. 8, into shell 12. It is in this position that nail 40 of digit 38 may be cut by clipper 26.

In the second embodiment, clipper 26 is inserted into second opening 22 and third opening 24 by first removing bottom portion 114 from top portion 116 (not shown). Clipper 26 is then threaded through the openings so that front end 36 is positioned in the interior of shell 12 and cutting portion 34 projects through second opening 22 and extends outwardly from shell 12. Handle 32 of clipper 26 projects through third opening 24 and also extends outwardly from shell 12. Subsequent to the insertion of clipper 26 into bottom portion 114, top portion 116 is attached thereto and grommet 30 (not shown) is adjusted so that it securely fits around the openings. The digit is then inserted into first opening 118 of the second embodiment an nails are cut in a manner similar to that described in the first embodiment.

A third embodiment shows a container 310 (FIGS. 10–13) which also has a hollow shell 312 having a bottom portion 314 which is smaller than the upper portion 316. Alternatively, shell 312 of the third embodiment may include a detachably removable lid 316A. The container 310 of the third embodiment includes a first opening 318A and 318B and a second opening 320A and 320B. A digit is adapted to fit into first opening 318A and 318B and a nail clipper 26 is adapted to fit into second opening 320A and 320B.

Figure 11:
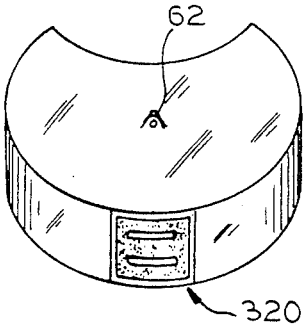
FIG. 11 is another perspective view of the inventive container of FIG. 10, illustrating the grommet that covers the second opening.
Figure 12A:
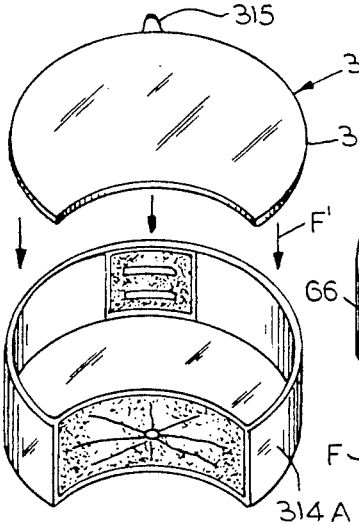
FIG. 12A is a perspective view of the inventive container of FIG. 10, illustrating an alternate detachably removable top.
Figure 13:
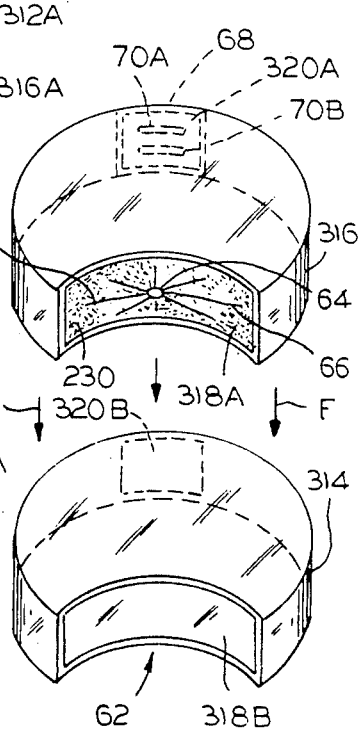
FIG. 13 is a perspective view of the inventive container of FIG. 10, illustrating the top portion detached from the bottom portion.
Figure 12:
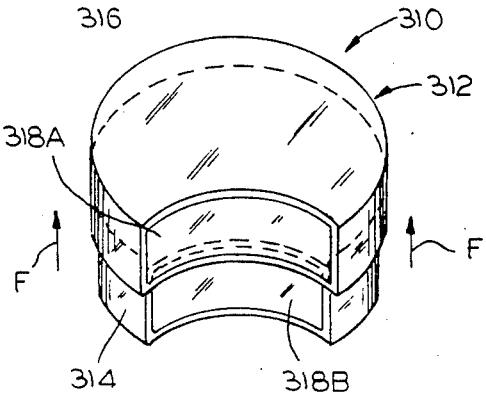
FIG. 12 is a perspective view of the inventive container of FIG. 10, illustrating the slidably detachable top and bottom portions.

In the third embodiment (FIGS. 10–13), shell 312 includes a bottom portion 314 which is smaller than upper portion 316 and removably detachable therefrom, as indicated by arrows F in FIGS. 12 and 13. Shell 312 further includes a recessed portion 62 which frames opening 318A of top portion 316 and opening 318B of bottom portion 314. When shell 312 is in its closed position (FIG. 10), opening 318A is aligned with opening 318B and produces opening 318. Likewise, opening 320A of top portion 316 and opening 320B of bottom portion 314 are diametrically opposed to openings 318A and 318B. (FIG. 13).

Referring to FIG. 13, opening 318A of top portion 316 is partially covered by a flexible grommet 230 that has a small hole 64 in the center thereof. Slits 66 extend radially outwardly from hole 64. In the preferred embodiment, opening 318B of bottom portion 314 does not include a grommet but is instead open so that the interior of lower portion 314 may be reached through grommet 230 when shell 312 is in its closed position. However, alternatively, both opening 318A and 318B may be framed by grommet 230.

Referring to FIGS. 11 and 13, opening 320A of top portion 316 also is partially covered by a flexible grommet 68 having at least two slits 70A, 70B therein. In the preferred embodiment, opening 320B of bottom portion 314 does not include a grommet but is open so that the interior of lower portion 314 may be reached through grommet 68 when shell 312 is in its closed position. However, opening 320B may also alternatively include a grommet.

Clipper 26 is inserted into shell 312 by the sam method described in relation to the second embodiment. Specifically, bottom portion 314 is slidably removed from top portion 316 wherein clipper 26 is positioned in the interior of bottom portion 314, with cutting portion 34 projecting through the lower slit 70B and handle 32 of clipper 26 projecting through the higher slit 70A. Both cutting portion 34 and handle 34 of clipper 26 extend outwardly from shell 312. Subsequent to the insertion of clipper 26 into bottom portion 314, top portion 316 is attached thereto. A digit is then inserted into openings 318A and 318B and the nails are cut in a manner similar to that described in the first and second embodiments. The recessed portion 62 of the third embodiment allows for the inserted digit to be closer to the clipper 26.

FIG. 12A illustrates an alternate structure for the container of the third embodiment shown in FIGS. 10–13. In FIG. 12A, shell 312A includes a bottom portion 314A and a removably detachable upper portion or lid 316A, as indicated by arrows F'. Lid 316A further includes a lifting tab 315 which is positioned along the perimeter of lid 316A and which provides a mechanism for removing lid 316A from bottom portion 314A. Clipper 26 is then inserted into shell 312A in the same manner described above in the third embodiment.

In the first, second and third embodiments, the clipped nails fall to the bottom of shell 12, 112, 312 subsequent to their removal from the digit by clipper 26. Upon completion of the cutting process, the cut nails may be emptied from shell 12, 112, 312 by removing top portion 16, 116, 316 and discarding the contents of same.

In the first, second and third embodiments, the top portions 16, 116, 316 may include a small ring 62 (FIGS. 1–4, 6, 10–16) so that containers 10, 110, 310 may be carried around on a chain or the like.

A fourth embodiment shows a container 210 (FIGS. 10–16) which also has a hollow shell 212 having a lower portion 214 which is larger than the perimeter of the top portion 216. The container 210 of the fourth embodiment includes a first opening 218 and a second opening 220. A foot is adapted to fit into first opening 218 and a nail clipper 26 is adapted to fit into second opening 220.

Figure 14:
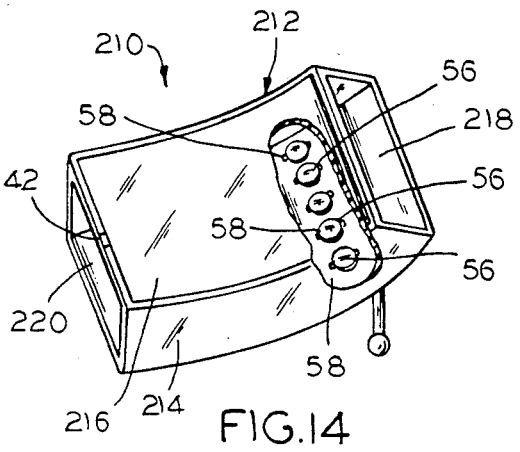
FIG. 14 is a perspective view of a fourth embodiment of the inventive container.

In the fourth embodiment, container 210 includes a generally inwardly curved, hollow shell 212 with a lower portion 214 having a larger perimeter than top portion 216, as shown in FIG. 14. A tab 42 projects out from top portion 216 and is used to remove same from bottom portion 214. At least two legs 44 extend outwardly from one end of the bottom portion 214 which maintain that end of shell 212 at a certain height.

Shell 212 includes a first opening 218 and an oppositely positioned second opening 220. Both openings 218 and 220 are partially covered by a flexible grommet 130 which enables objects, including nail clippers and the front portion of a foot, to move into and out of shell 212 while prohibiting the contents therein from falling out.

Figure 15:
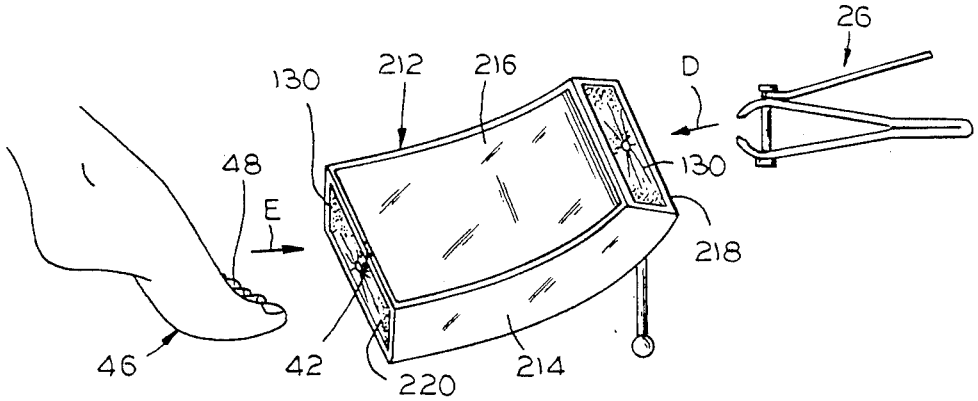
FIG. 15 is a perspective view of the inventive container of FIG. 14, illustrating the insertion of a foot and the nail clipper of FIG. 7 into the container.

FIG. 15 illustrates the manner in which nail clippers 26 and foot 46 are inserted into shell 212. Clippers 26 are inserted into first opening 218 through grommet 130, as indicated by arrows D, whereas the front portion 48 of foot 46 is inserted into second opening 220 through grommet 130, as indicated by arrows E.

Shell 212 further includes a detent mechanism 50 which comprises a plurality of actuators 52 (FIG. 16) and recesses 56 (FIG. 14) which are located beneath and on the exterior of lower portion 214. The actuators 52 are adapted to slideably move vertically and rotatably within recesses 56 and to elevate an individual toe inside of shell 212.

Figure 16:
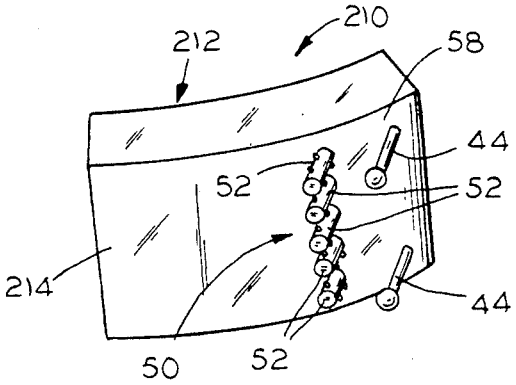
FIG. 16 is a perspective view of the inventive container of FIG. 14, illustrating the detent mechanism located beneath the container.
Figure 17:
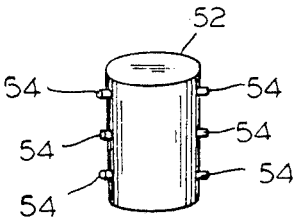
FIG. 17 is a perspective view of the actuator which is used in the detent mechanism of FIG. 16 to elevate individual toes.

Actuators 52 are small protuberances which include a plurality of tab pairs 54 that project outwardly therefrom. (FIGS. 16 and 17). Recesses 56 include diametrically opposed notches 58 (FIG. 14) into which tab pairs 54 are adapted to slideably move within. Actuators 52 slide within each recess 56 when tab pair 54 is in alignment with notches 58. Once tab pair 54 is positioned in the interior of shell 212, actuator 52 is locked into place by rotating it either clockwise or counterclockwise so that tab pair 54 is no longer aligned with recesses 56.

Figure 18:
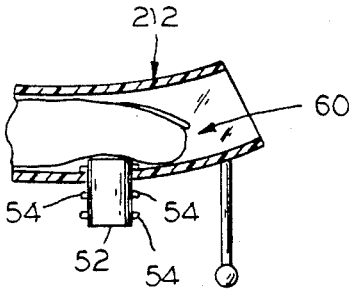
FIG. 18 is a side view of the actuator of FIG. 17, shown in its first position relative to a toe within the inventive container of FIG. 14.
Figure 19:
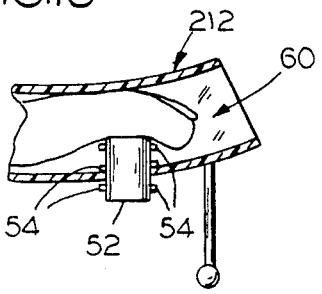
FIG. 19 is a side view of the actuator of FIG. 17, shown in its second position relative to a toe within the inventive container of FIG. 14.

Referring to FIGS. 17–19, it is shown that actuator 52 includes several tab pairs 54. Thus, it is possible to elevate a toe 60 to several different heights depending upon which set of tab pairs 54 is used to lock actuator 52 into place within shell 212. FIG. 18 illustrates toe 60 inside of shell 212 prior to elevation by actuator 52, whereas FIG. 19 shows toe 60 inside of shell 212 in a first position subsequent to its elevation by using the first set of tabs 54 to lock actuator 52 into position.

Figure 20:
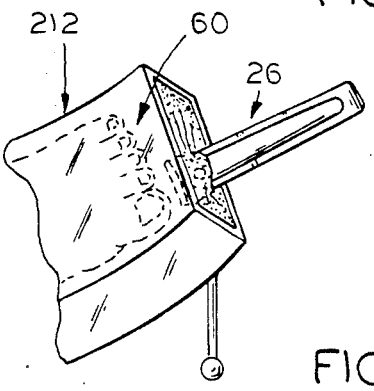
FIG. 20 is a perspective view of the inventive container of FIG. 14, illustrating the cutting process.

Subsequent to the height adjustment of each toe 60 by detent mechanism 50, the toes may cut by the method described in FIG. 15. FIG. 20 shows foot 46 as inserted into shell 212 during the cutting process by clipper 26. Similarly to the first, second and third embodiments, the clipped toenails will fall to the bottom of shell 212 after being cut. The cut nails may then be emptied from shell 212 by removing top portion 216 via tab 42 and discarding contents of same.

Due to the structure and curvature of the human foot, it is necessary to have a container 210 for the left foot and another container 210 for the right foot. For purposes of illustration of this embodiment, the drawings reflect a left foot container. However, it should be understood that a right foot container is the mirror image of the left foot container as described herein, except for an opposite lateral curvature of the container.

The materials from which container 10, 110, 210 and 310 of the different embodiments are constructed could be a myriad of materials, including plastic, glass and any other materials that are sturdy and transparent. Preferably, the upper portion of each container is transparent whereas the lower portion is opaque or colored. The grommet 30, 130 which covers all of the openings of the containers may be made from any rubber or plastic product.

Moreover, containers 10, 110, 210 and 310 have not been described in terms of approximate measurements, as it should be understood that the size of containers 10, 110, 210 and 310 may vary according to need.

Therefore, it should be recognized that, while the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

What is claimed is:

1. A container for retaining nail clippings trimmed by a cutting tool comprising a hollow shell having a first opening and a second opening, wherein said first opening and said second opening are partially covered by a grommet and are diametrically opposed to one another, said first opening for receiving a digit and said second opening for receiving said cutting tool, whereby when said digit is inserted through said first opening and said cutting tool is inserted through said second opening and applied to the nail of the digit, the shell retains the nail clippings trimmed from said digit.

2. The container of claim 1 wherein said shell includes a top portion and a removably detachable bottom portion.

3. The container of claim 1 wherein said first opening is located in a recessed portion of said shell.

4. A container for retaining nail clippings trimmed by a cutting tool comprising a hollow shell having a first opening and a second opening, said first opening for receiving a digit and said second opening for receiving said cutting tool, whereby when said digit is inserted through said first opening and said cutting tool is inserted through said second opening and applied to the nail of the digit, the shell retains the nail clippings trimmed from said digit, said container further comprising at least one slidably movable actuator means for elevating said digit within said container, each of said actuator means extending through an opening on the underside of said container.

5. The actuator means of claim 4 further comprising at least one tab extending outwardly from said actuator means, and wherein said opening includes a corresponding notch for receiving said tab.

6. A container for retaining clipped nails after they have been trimmed by a cutter, comprising a hollow shell having a first opening, a second opening, and at least two grommets, said first opening and said second opening being diametrically opposed to one another, said first opening for receiving at least one digit and said second opening for receiving said cutter, wherein said grommets cover said first opening and said second opening, whereby when said digit is inserted through said first opening and said cutter is inserted through said second opening and applied to the nail of the digit, the shell retains the nail clippings trimmed from said digit.

7. A container for retaining clipped nails after they have been trimmed by a cutter, comprising a hollow shell having a first opening, a second opening, and at least two grommets, said first opening for receiving at least one digit and said second opening for receiving said cutter, wherein said grommets cover said first opening and said second opening, whereby when said digit is inserted through said first opening and said cutter is inserted through said second opening and applied to the nail of the digit, the shell retains the nail clippings trimmed from said digit, said container further comprising a slidably movable actuator means for elevating said digit within said container, said actuator means extending partially through an opening in said container, and locking means associated with said actuator means for maintaining said actuator means in a desired position.

* * * * *